United States Patent [19]

Boyes et al.

[11] Patent Number: 4,951,650

[45] Date of Patent: Aug. 28, 1990

[54] GAS FIRE APPLIANCE

[75] Inventors: Michael Boyes, Derby; Alan M. Lloyd; Martin L. Smith, both of Birmingham; Alan Constable, Coleshill, all of England

[73] Assignee: Valor Heating Limited, England

[21] Appl. No.: 322,072

[22] Filed: Mar. 10, 1989

[30] Foreign Application Priority Data

Mar. 16, 1988 [GB] United Kingdom ..... 8806228

[51] Int. Cl.[5] ..... F24C 3/00

[52] U.S. Cl. ..... 126/92 R; 126/92 AC; 431/125

[58] Field of Search ..... 431/125; 126/92 R, 92 C, 126/92 AC; 239/DIG. 19

[56] References Cited

U.S. PATENT DOCUMENTS

| | | | |
|---|---|---|---|
| 2,268,279 | 12/1941 | Debenham et al. | 239/DIG. 19 |
| 4,573,446 | 3/1986 | Rosiek et al. | 126/92 R |
| 4,584,147 | 4/1986 | Stehning | 239/DIG. 19 |
| 4,602,609 | 7/1986 | Wright | 126/92 R |
| 4,726,351 | 2/1988 | Whittaker et al. | 431/125 |
| 4,883,043 | 11/1989 | Thow | 431/125 |

FOREIGN PATENT DOCUMENTS

| | | | |
|---|---|---|---|
| 266152 | 2/1927 | United Kingdom . | |
| 380352 | 9/1932 | United Kingdom . | |
| 2081885A | 7/1980 | United Kingdom . | |
| 2119921A | 4/1982 | United Kingdom . | |
| 2137336 | 10/1984 | United Kingdom | 126/92 AC |
| 2163249A | 5/1985 | United Kingdom . | |
| 2181228A | 10/1985 | United Kingdom . | |
| 2189025 | 10/1987 | United Kingdom | 126/92 R |

*Primary Examiner*—Carroll B. Dority

*Attorney, Agent, or Firm*—Andrus, Sceales, Starke & Sawall

[57] ABSTRACT

A gas fire appliance having a casing with a rear face at which a plurality of alumina flame effect burner tubes are supported, the tubes extending through a ceramic deflector plate supported over the rear face and lying behind a solid fuel simulating element which is relatively steeply raked to be visible through an adjacent front glass panel of the appliance. A dual-section main heater burner with a pair of metallic flame effect burners secured to one side thereof is positioned below the solid fuel simulating element, the flames therefrom being deflected upwardly by the plate. A gas control knob is operable to turn on all the burners or to select various ones thereof only as required. The steep rake of the fuel bed ensures that the visual appearance of the appliance is enhanced by fully presenting the working area and the alumina burner tubes positioned in the high temperature fuel bed ensure an effective living flame effect of high efficiency.

11 Claims, 3 Drawing Sheets

Figure 1:
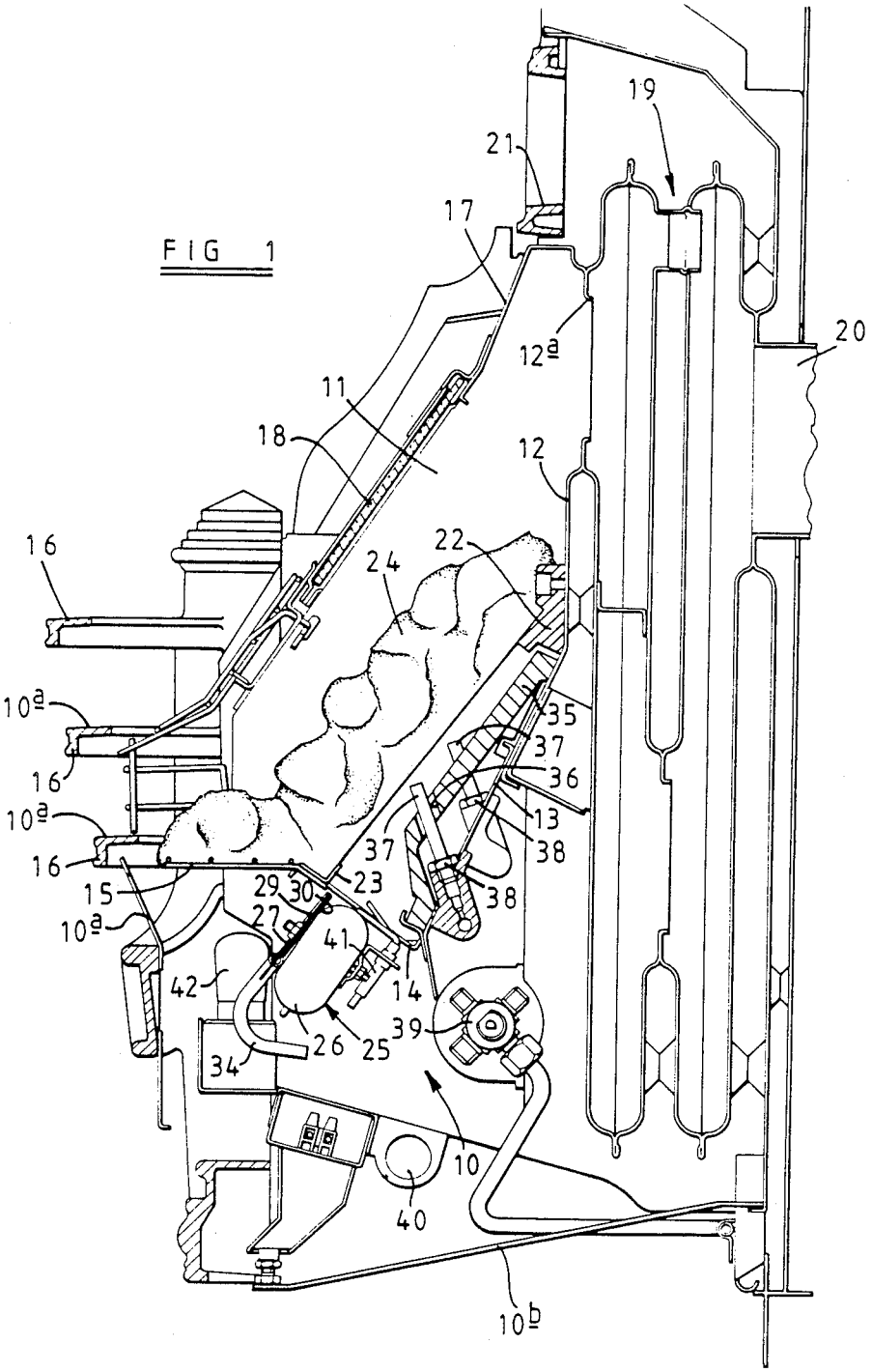

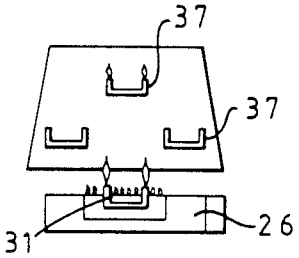
FIG 3
FIG 4
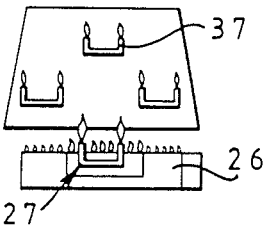
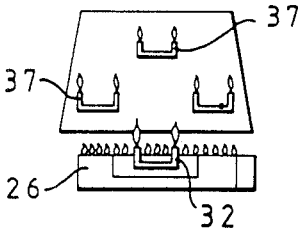
FIG 5
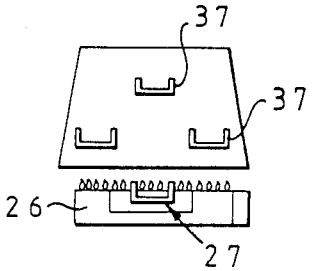
FIG 6

GAS FIRE APPLIANCE

This invention relates to a gas fire appliance of the kind which, while having a supply of gas to be burnt to produce heat, gives the appearance of an open fire with coal, coke or logs, namely solid fuel.

With a gas fire appliance of this kind, there is a main, heater burner, and also several flame effect burners adjacent, and possibly secured to, one side thereof. The flames issuing from the heater burner are nearly invisible and are primarily for heating fuel simulating elements supported within the casing of the fire. The flame effect burners each have a lower air content in its combustible mixture so as to produce flames which are luminous and more visible. These flames pass between the fuel simulating elements to produce a simulated flame effect which gives a realistic impression of an open fire. A gas fire with a burner arrangement of this type is disclosed in our U.K. Pat. No. 2,170,902B (U.S. Pat. No. 4,602,609).

However this type of dual burner arrangement is only suitable where the fuel bed is sloped at a relatively small angle to the horizontal and the fuel simulating elements are thus only partially displayed through a glass front cover of the fire. The fire is thus square-fronted.

If a gas fire is required where there is a full display of the fuel simulating elements, i.e. the working area of the fire, for example in a so-called 'basket fire', it is necessary considerably to increase the angle of the fuel bed to make it much steeper. The dual type of burner arrangement described is not suitable for use with such a steeper raked fuel bed, even if repositioned relative to the fuel simulating elements. It is not possible for the flames to permeate the fuel simulating elements in the route required for the desired display and in particular the lower part of the fuel simulating elements has no visible flames. A lack of heat at the bottom of the fuel bed, i.e. in ceramic rods mounting the fuel simulating elements, causes soot to be formed.

Additionally in order to maintain the required attractive visual appearance of the working area of the fire, the glass front cover of the fire must be in close proximity to the fuel bed. However the flames must not impinge on the glass cover, in use, otherwise soot will form on its inner surface.

Thus, the dual type of burner arrangement presently known is only suitable for use in particular designs of fire casings and for low efficiency gas fires with a relatively low temperature fuel bed.

An object of the present invention is to provide a gas fire appliance which overcomes the above-mentioned disadvantages. A further object is to provide a burner arrangement for such a gas fire appliance.

According to one aspect of the invention there is provided a gas fire appliance comprising a casing including support means on which solid fuel simulating elements are supported, a heater burner, to which, in use, gas to be burnt is supplied, the heater burner being arranged to direct gas to be burnt below the solid fuel simulating elements for the purpose of heating those elements, and at least one flame effect burner remote from the heater burner for producing a visible flame effect between and/or in front of the solid fuel simulating elements.

According to another aspect of the invention there is provided a burner arrangement for a gas fire appliance comprising a heater burner, to which, in use, gas to be burnt is supplied, the heater burner being intended to be arranged, in use, in said gas fire appliance to direct gas to be burnt below solid fuel simulating elements carried on support means, and at least one flame effect burner remote from the heater burner for producing, in use, a visible flame effect between and/or in front of the solid fuel simulating elements.

Preferably an at least partially transparent panel partially encloses a space defined within the casing in front of the solid fuel simulating elements, the panel being at the same or substantially the same angle to the horizontal as said solid fuel simulating elements.

Conveniently each of the flame effect burners is formed as a tube of high alumina positioned in an opening in a ceramic plate or pad disposed below the solid fuel simulating elements, each tube being fed with gas, in use, to produce said visible flame. Preferably six such tubes are provided, being fed in pairs from the gas supply line.

Figure 2:
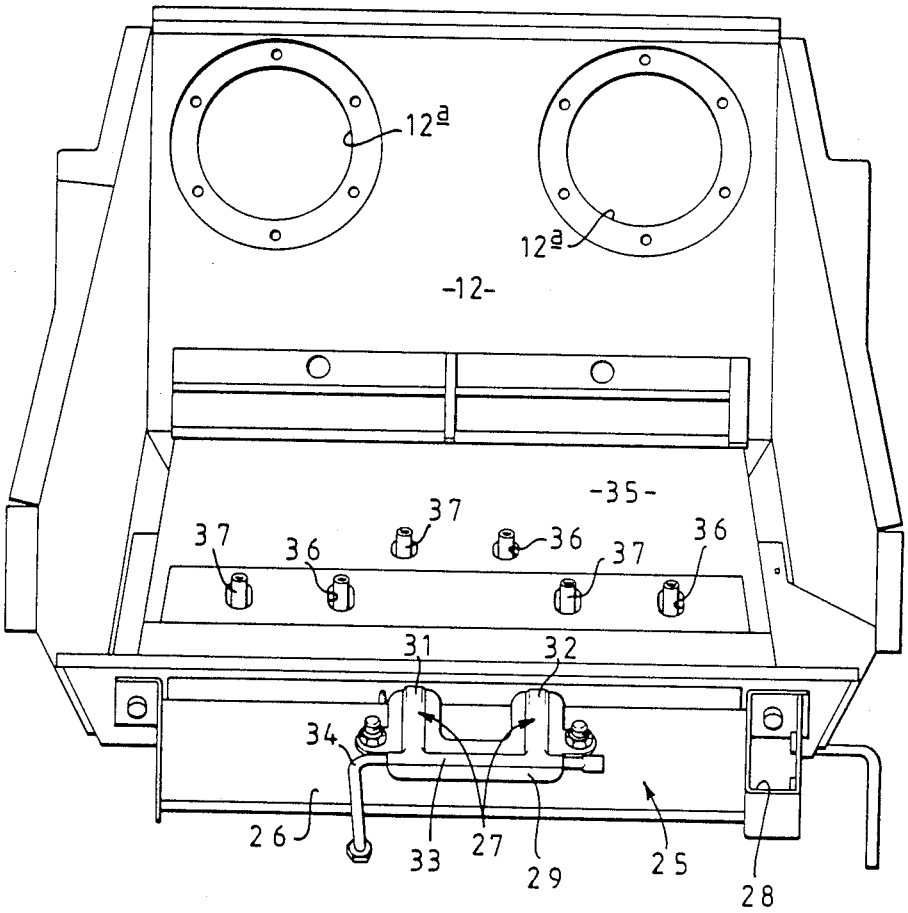

The invention will now be described, by way of example, with reference to the accompanying drawings, in which:

FIG. 1 is a cross-sectional side elevation view of a gas fire appliance constructed according to the invention, FIG. 2 is a front view of part of the interior of a casing of the gas fire appliance, with a fuel bed thereof removed, and FIGS. 3 to 6 schematically show the states of a heater burner and flame effect burners for different positions of a gas control knob of the appliance.

FIG. 1 shows a multi-part frame 10 of the appliance. The frame has air inlet openings 10*a* at the front lower end for the entry of air for combustion purposes. A main central portion of the frame defines a full width cavity in which is disposed a radiant box 11.

The radiant box 11 has an upper vertical rear wall 12 and a lower rear wall 13 which slopes downwardly towards a front of the appliance. At the bottom of the rear wall 13 is a bottom wall 14 sloping upwardly at about 80° therefrom towards the front of the appliance and a further bottom grill 15 which extends horizontally to the extreme front of the fire where three relatively spaced, vertically arranged decorative bars 16 are provided, forming a lower front of the fire. At the upper front part of the radiant box 11 is a front wall 17 which slopes downwardly from the top of the wall 12 towards the front of the appliance. The front wall 17 defines a generally rectangular opening in which is disposed a transparent panel 18, preferably a glass panel. Along its upper edge, the panel 18 is received in a channel-shaped enlargement of the wall 17. The top and side edges of the panel are sealed, but an opening is defined at its lower edge. The panel 18 thus slopes upwardly and rearwardly at the front of the appliance. The panel may be of any heat resisting glass or similar material, and may be wholly transparent or translucent in certain proportions to provide a desired visual effect.

In the vertical rear wall 12 of the radiant box 11 are two circular openings 12*a* which communicate with a twin heat exchanger assembly 19 mounted vertically at the rear of the frame 10. A flue outlet 20 extends rearwardly from the assembly 19. The frame 10 defines an air passage so that air can enter the front of the appliance, be heated by passage over the heat exchanger assembly and then leave the appliance by way of an outlet 21 in an upper front part of the appliance. Air also enters at the lower part of the appliance to feed the burners (to be described) and to provide convection air passing over the heat exchanger assembly. A floor plate 10b diverts this convection air to the heat exchanger assembly.

At the junction of the walls 12 and 13 an elongated support element 22 extends horizontally along the inside of the radiant box 11. The wall 14 has, near its uppermost edge, a short upstanding flange 23 extending across the inside of the bottom of the radiant box 11 and a ceramic fuel bed 24 is fitted in the radiant box 11 which respective upper and lower edges being supported by the element 22 and flange 23.

The fuel bed can be of conventional form, for example comprising coke, coal or log simulating elements, or any combination thereof, or any other solid fuel. A front portion of the fuel bed can extend forward over the grill 15 and thus extend further to the front of the appliance, whilst the main part of the fuel bed slopes rearwardly at the same angle as the panel 18. The appearance is thus of an open fire, the steep angle of the fuel bed and the close proximity of the panel 18 thereto providing the attractive visual appearance of a 'basket fire' with the 'working area' of the fire completely displayed.

The wall 14 is provided with one or more openings and mounted therebelow is a burner assembly 25, also shown in FIG. 2, comprising a main, heater burner 26 and a pair of flame effect burners 27 attached thereto.

As shown in FIGS. 1 and 2, the heater burner 26 is in the form of a generally elongated, closed ended metal box structure and it has a plurality of narrow vertical slots or holes or a combination of slots and holes (not shown) spaced along the length of its upper surface forming flame ports of the burner. The burner 26 can be formed with a single section, but preferably it has at least two sections, such as a central, inner section and an outer section lying on either side of the inner section. The flame port outlets of the inner section are provided with a gas nozzle (not shown) which entrains air from a gap 28 at one end of the burner 26 to form a combustible mixture which then passes along a tube (not shown) and thence into a box (not shown) formed below the inner flame ports.

The outer section burner flame ports are provided, in use, with a combustible mixture which enters into a chamber, around said box below the inner section flame ports, via a tube (not shown) which receives gas from a nozzle (not shown), air again being entrained from said gap 28 before the combustible mixture enters the pipe leading to said chamber.

Any combustible gas and air mixture issuing from the flame ports in the inner and/or outer burner sections is directed in an upwardly and rearwardly inclined direction into the radiant box beneath the ceramic fuel bed 24. The burner is substantially of the same form as that described and illustrated in our U.K. Pat. No. 2,170,902B.

The pair of flame effect burners are formed by two generally U-shaped metal pressings 29, 30 which are rivetted or otherwise retained together, so that respective gas passages 31, 32 are formed in the limbs. The gas passages communicate with a transverse circular-section passage 33 in which a circular-section pipe 34 is disposed. One end of the pipe 34 outside the pressings is closed, whilst the other end extends from the pressings and is connected to a gas supply control arrangement (to be described). The gas feed pipe 34 has a pair of openings therein communicating with the respective gas passages 31, 32. Each flame effect burner formed by the two pressings has a rectangular section gas passage. Air is supplied to each burner by suitable apertures at the bottoms of the gas passages 31, 32 respectively, but such apertures provide a lower air content than is the case with the heater burner outlets, so that the flames from the flame effect burners 27 are luminous and more visible than the flames issuing from the heater burner. The connected pressing is bolted to one side of the heater burner so that the burners are directed into the simulated fuel bed 24.

It will be appreciated that the number of sections of the heater burner can be varied as required and all the sections can be controlled independently or some or all can be controlled together. Similarly the flame effect burners could be omitted, or a single flame effect burner or more than two flame effect burners could be provided, again all controllable independently or all or some controllable together.

The lower rear wall 13 carries an elongated, soft ceramic pad 35 arranged to direct upwardly flames from both the heater burner and the flame effect burners. The flames from the heater burner primarily heat the solid fuel simulating elements and the amount of air supplied for combustion of the gas of the burner 26 is regulated to provide the most efficient burning for that purpose. The pad 35 can be manufactured from other heat resistant materials.

The flame effect burners produce luminous flames as described, and these pass between and/or in front of the solid fuel simulating elements at the lower part of the fuel bed to produce a simulated flame effect which produces a very realistic impression of an open fire. However to enhance this impression, and to provide adequate heating at the lower part of the fuel bed, the appliance shown in FIG. 1 also includes further flame effect burners beneath the fuel bed.

The pad 35 has three pairs of circular or generally circular-section apertures therethrough, only one of which 36 is shown in FIG. 1. Each aperture is angled slightly upwardly towards the fuel bed. FIG. 2 and FIGS. 3 to 6 schematically show the positions of the pairs of apertures, namely an upper pair centrally of the pad and two lower pairs symmetrically at the sides thereof. However the numbers of apertures, as well as the arrangement and location thereof can be varied as required.

Passing through each aperture is a cylindrical ceramic flame effect or flicker tube 37, the upper end of which is disposed slightly proud of the pad surface but below the bottom of the ceramic bed 24. The rear wall 13 carries respective tubular, flanged supports 38 for the tubes 37, the lower end of each projecting below the wall 13 for connection to the gas supply via a brass manifold or the like. All the gas supply pipes are generally shrouded by the radiant box. The arrangement of the tubes below the bed 24 can of course be varied from that shown, as described with their associated apertures 36.

Preferably each tube is made of high alumina. The underbed area into which the tubes project is, in use, too hot for metal burners which would degrade. The use of ceramic material tubes overcomes this problem and a thermal pull effect occurs whereby the hot area can induce a flame at the tube. Each tube is exactly positioned and there is no danger of its flame licking the glass panel 18 and forming soot. The flames from the flicker tubes thus merely pass over and between the solid fuel simulating elements and provide sufficient heat at the bottom part of the fuel bed to prevent soot formation. Like the burners 27, the flames from these burners projecting through the pad 35 produce a realistic impression of an open fire.

The use of alumina prevents distortion and corrosion of the flame effect burner tubes 36.

As stated, the number and arrangement of underbed flicker burners can be varied from that shown and described, and the control of gas supply to them can also be varied as required.

For the particular embodiment of the invention described, a four position gas control 39 (not shown) is provided to feed the burners as will be described. The appliance can incorporate an automatic ignition arrangement at 40 as well as a device for detecting absence of flame when the gas is on. A spark electrode to which a thermocouple of the flame failure device is adjacent is shown at 41. Electric underbed lighting, as shown at 42, can also be provided.

In the first on position of the control knob, the inner heater burner section is on full, whilst the outer heater burner sections are off. The flame effect burners 27 are fully on, as are the two centre tubes of the underbed flicker burners. The outer pairs of tubes of the underbed burners are off. This state of operation of the appliance is shown in FIG. 3.

FIG. 4 shows the state of the appliance with the control knob in its second on position. Now the position is the same as with FIG. 3, except that the outer heater burner sections are now half on, and the remaining underbed burners are full on.

As shown in FIG. 5, the third on position of the control knob produces the arrangement as shown in FIG. 4, except that the outer heater burner sections are now full on so that the heater burner as a whole is full on.

Finally with the control knob in its fourth on position, the heater burner as a whole is full on, but all the flame effect burners are off, as shown in FIG. 6. In this state any soot or other deposit on the fuel bed may possibly be burnt off by the heater burner flames.

In alternative embodiments, the control of gas supplied to all the burners can of course be different from that described. There can be a different number of control outlets or gas controls.

Accordingly the invention provides an improved burner arrangement for a live fuel effect gas fire appliance, and also an improved appliance. It can be seen that the fire illustrated has a steeply inclined bed and correspondingly inclined glass panel. The aesthetic appearance of the fire is thus particularly attractive and the invention allows a new generation of outer frame designs to be used as alternatives to the normal square fronted fires.

The problems referred to concerning the use of the conventional metallic main and secondary burner arrangement are overcome by the use of the underbed flicker tubes and in particular their precise positioning and material of manufacture. The high efficiency of the appliance and thus the high temperature fuel bed do not affect the ceramic material of the tubes and their positioning in the pad provides, in use, the correct flames to produce the living flame effect whilst burning correctly and not contacting the glass cover. The whole working area of the fire is readily visible assisted by the close proximity of the glass cover to the fuel simulating elements.

Although the embodiment of the fire described and illustrated is non-inset, an alternative semi-inset version could be produced.

We claim:

1. A gas fire appliance comprising a casing including inclined support means on which solid fuel simulating elements are supported, a heater burner, to which, in use, gas to be burnt is supplied, the heater burner being arranged to direct gas to be burnt below the solid fuel simulating elements for the purpose of heating those elements, at least one flame effect burner remote from the heater burner for producing a visible flame effect between and/or in front of the solid fuel simulating elements, a member disposed behind the solid fuel simulating elements, said casing having an angled rear face, said member being supported by the angled rear face of the casing, and the or each flame effect burner projecting through said member.

2. An appliance as claimed in claim 1, wherein the or each flame effect burner is carried by a support at said rear face of the casing.

3. An appliance as claimed in claim 2, wherein the or each flame effect burner is formed of ceramic material.

4. An appliance as claimed in claim 3, wherein the or each flame effect burner is an alumina tube.

5. An appliance as claimed in claim 4, wherein three pairs of said flame effect burners are provided, two outer pairs being symmetrically disposed at opposite sides of a centre line of the casing and at the same level, and the other pair being disposed centrally between and higher than the outer pairs.

6. An appliance as claimed in claim 5, wherein the heater burner has at least one further flame effect burner adjacent thereto to direct its flame or flames in the same direction as the heater burner flames.

7. An appliance as claimed in claim 6, wherein a pair of said further flame effect burners are formed between a pair of metallic elements connected together and connected to one side of the heater burner to lie centrally of its length.

8. An appliance as claimed in claim 7, wherein said heater burner has a central inner burner section and outer burner sections at the opposite sides thereof respectively, the pair of said further flame effect burners being aligned longitudinally of the heater burner with said central inner burner section.

9. An appliance as claimed in claim 6, wherein a multi-position control member is provided to supply gas to the burners, one position placing all the burners fully on and a further position placing the heater burner full on only.

10. An appliance as claimed in claim 9, wherein a third position places the inner heater burner section, the further flame effect burners and the central flame effect burners full on with all other burners off, and a fourth position additionally places the other outer flame effect burners full on and the outer heater burner sections half on.

11. An appliance as claimed in claim 1, wherein an at least partially transparent panel partially encloses a space defined within the casing in front of the solid fuel simulating elements, the panel being at the same or substantially the same angle to the horizontal as the solid fuel simulating elements.

* * * * *